US007730690B2

(12) United States Patent
Miller et al.

(10) Patent No.: US 7,730,690 B2
(45) Date of Patent: Jun. 8, 2010

(54) COMPRESSION POST ASSEMBLY FOR WIND UP-LIFT OF SUSPENSION SOFFITS

(75) Inventors: Gary F. Miller, Palatine, IL (US); Gregory L. Sallay, Avon Lake, OH (US)

(73) Assignee: USG Interiors, Inc., Chicago, IL (US)

( * ) Notice: Subject to any disclaimer, the term of this patent is extended or adjusted under 35 U.S.C. 154(b) by 460 days.

(21) Appl. No.: 11/616,360

(22) Filed: Dec. 27, 2006

(65) Prior Publication Data

US 2008/0155936 A1 Jul. 3, 2008

(51) Int. Cl.
*E04B 9/18* (2006.01)
*E04B 9/20* (2006.01)

(52) U.S. Cl. ..... 52/506.05; 52/506.07; 52/506.08; 52/39; 52/745.05; 248/333; 248/354.1

(58) Field of Classification Search ..... 52/39, 52/220.3, 484, 488, 506.05–506.08, 741, 52/764, 769, 22, 655.1, 745.05; 248/200.1, 248/333, 354, 354.1, 317, 343, 581, 589; 403/109, 365

See application file for complete search history.

(56) References Cited

U.S. PATENT DOCUMENTS

| | | | | | |
|---|---|---|---|---|---|
| 855,626 | A | * | 6/1907 | Furru | 74/522 |
| 1,369,975 | A | * | 3/1921 | Johnson | 228/144 |
| 2,297,869 | A | * | 10/1942 | Biller | 248/343 |
| 3,035,672 | A | * | 5/1962 | Tuten et al. | 52/656.8 |
| 3,081,398 | A | * | 3/1963 | Karth | 362/150 |
| 3,089,570 | A | * | 5/1963 | O'Neil, Jr. | 52/713 |
| 3,212,466 | A | | 10/1965 | Wintersteen | |
| 3,263,388 | A | * | 8/1966 | Bogert | 52/665 |
| 3,390,856 | A | * | 7/1968 | Buren, Jr. | 248/317 |
| 3,419,295 | A | * | 12/1968 | Small | 403/92 |
| 3,425,428 | A | * | 2/1969 | Schwartz | 135/114 |
| 3,498,166 | A | * | 3/1970 | Pook | 83/23 |
| 3,506,227 | A | * | 4/1970 | Jenkins | 248/59 |
| 3,606,224 | A | * | 9/1971 | Gutheim | 248/214 |
| 3,842,561 | A | | 10/1974 | Wong | |
| 3,880,535 | A | * | 4/1975 | Durham et al. | 403/241 |
| 4,004,390 | A | * | 1/1977 | Merkwitz | 52/506.07 |

(Continued)

OTHER PUBLICATIONS

International Preliminary Report on Patentability dated Jul. 9, 2009, International Application No. PCT/US2007/025203, International File Date Dec. 10, 2007.

*Primary Examiner*—Robert J Canfield
(74) *Attorney, Agent, or Firm*—Pearne & Gordon LLP

(57) ABSTRACT

A compression post assembly for a soffit, canopy or like structure utilizing a suspended grid of inverted tees to support the soffit surface forming panels comprising a main strut and a saddle coupling, the main strut having a hollow cross-section along substantially its full length between its upper and lower ends, the saddle coupling being adapted to connect the lower end of the strut to a grid tee by receiving separate self-tapping screws, one in each of the main strut and grid tee, the saddle coupling having a pair of spaced depending legs, the legs being spread apart by a distance sufficient to straddle the bulb of a conventional grid tee and having a length sufficient to engage the upper surfaces of the lower flange of the grid tee and thereby stabilize the grid tee against pivotal motion about a horizontal axis.

10 Claims, 4 Drawing Sheets

U.S. PATENT DOCUMENTS 4,015,811 A * 4/1977 Nute et al. ..... 248/343
4,036,466 A * 7/1977 Van Meter ..... 249/18
4,041,657 A * 8/1977 Schuplin ..... 52/39
4,084,364 A 4/1978 Jones
4,240,602 A * 12/1980 McDonald ..... 248/58
4,250,769 A * 2/1981 Herring ..... 74/525
4,308,863 A * 1/1982 Fischer ..... 606/57
4,545,166 A 10/1985 Kielmeyer
4,630,423 A * 12/1986 Lind ..... 52/506.06
4,866,900 A * 9/1989 Dunn ..... 52/506.07
4,905,952 A 3/1990 Pinquist
4,947,607 A 8/1990 Stein
5,313,759 A * 5/1994 Chase, III ..... 52/506.06
5,351,980 A * 10/1994 Huang ..... 280/281.1
5,364,160 A * 11/1994 Fritschen et al. ..... 297/195.1
5,611,184 A * 3/1997 Felix et al. ..... 52/506.05
5,619,833 A * 4/1997 Neff ..... 52/506.07
5,772,169 A 6/1998 Blockley
5,893,250 A * 4/1999 Benvenuto et al. ..... 52/506.08
6,045,288 A 4/2000 Pasternak et al.
6,811,130 B1 * 11/2004 Oh ..... 248/343
6,848,459 B2 * 2/2005 Ma ..... 135/20.1
7,228,669 B1 * 6/2007 Yaraschefski ..... 52/506.06
7,255,315 B2 * 8/2007 Oh ..... 248/342
2002/0157332 A1 * 10/2002 Ziegler et al. ..... 52/220.3
2003/0106275 A1 6/2003 Kennedy
2005/0139742 A1 * 6/2005 Frisell ..... 248/317
2005/0257476 A1 * 11/2005 Saidoo et al. ..... 52/506.07
2007/0180787 A1 * 8/2007 Fecska ..... 52/506.06
2008/0250731 A1 * 10/2008 Wheeler ..... 52/167.1

* cited by examiner

COMPRESSION POST ASSEMBLY FOR WIND UP-LIFT OF SUSPENSION SOFFITS

BACKGROUND OF THE INVENTION

The invention relates to building construction and, in particular, components and their use in constructing suspended soffits.

PRIOR ART

Suspended overhead structures such as exterior soffits, canopies or like structures can be subjected to wind forces tending to lift them. When these wind forces exceed the weight of the soffit and the strength of any restraining structure, damage or destruction can occur. Commonly, exterior soffits are suspended from overlying structure, i.e. superstructure, by suspension wires. This technology has been borrowed from the techniques, equipment, tools, and skills developed with interior suspended ceilings. Products and techniques known in the art have been developed to hold-down or otherwise stabilize ceiling structures and soffits, but these approaches have not been fully effective. It is known in the prior art to provide rigid compression posts that extend downwardly from the building superstructure to engage a gridwork that supports the soffit or ceiling panels. However, prior art compression posts can exhibit limited strength and, in some instances, can be relatively complex and expensive.

SUMMARY OF THE INVENTION

The invention provides a system for constructing suspended exterior soffits, canopies, or like structures resistant to wind up-lift loads. The disclosed methodology and componentry provide a consistently high level of stability and strength in the suspended system. The system of the invention is uncomplicated in design, inexpensive to produce, and simple to install.

As disclosed, the invention comprehends a compression post assembly that includes two primary parts, one a main strut, and the other a telescoping or sliding saddle member. The main strut has a length cut just short of the distance between the overhead support or superstructure and the soffit. The saddle member is preferably configured to initially be slidably supported on the main strut and to straddle the bulb of a conventional grid tee and engage the lower flange of the tee on both sides of the bulb.

In its simplest form, the saddle member is configured as a circular tube telescoped with the main strut of the compression post assembly or with an extension of the main strut. This form of saddle member can be simply made by cutting a tube to a suitable length and diametrically slotting it along a portion of its length.

In the various disclosed versions of the compression post assembly, the saddle member extends over the bulb of a main tee and seats against the top surfaces of the lower flange on both sides of the bulb. The saddle member, being fixed both to the main strut and to the main tee, symmetrically supports and stabilizes the main tee so as to prevent it from twisting about a horizontal axis and failing.

DESCRIPTION OF THE PREFERRED EMBODIMENTS

Figure 1:
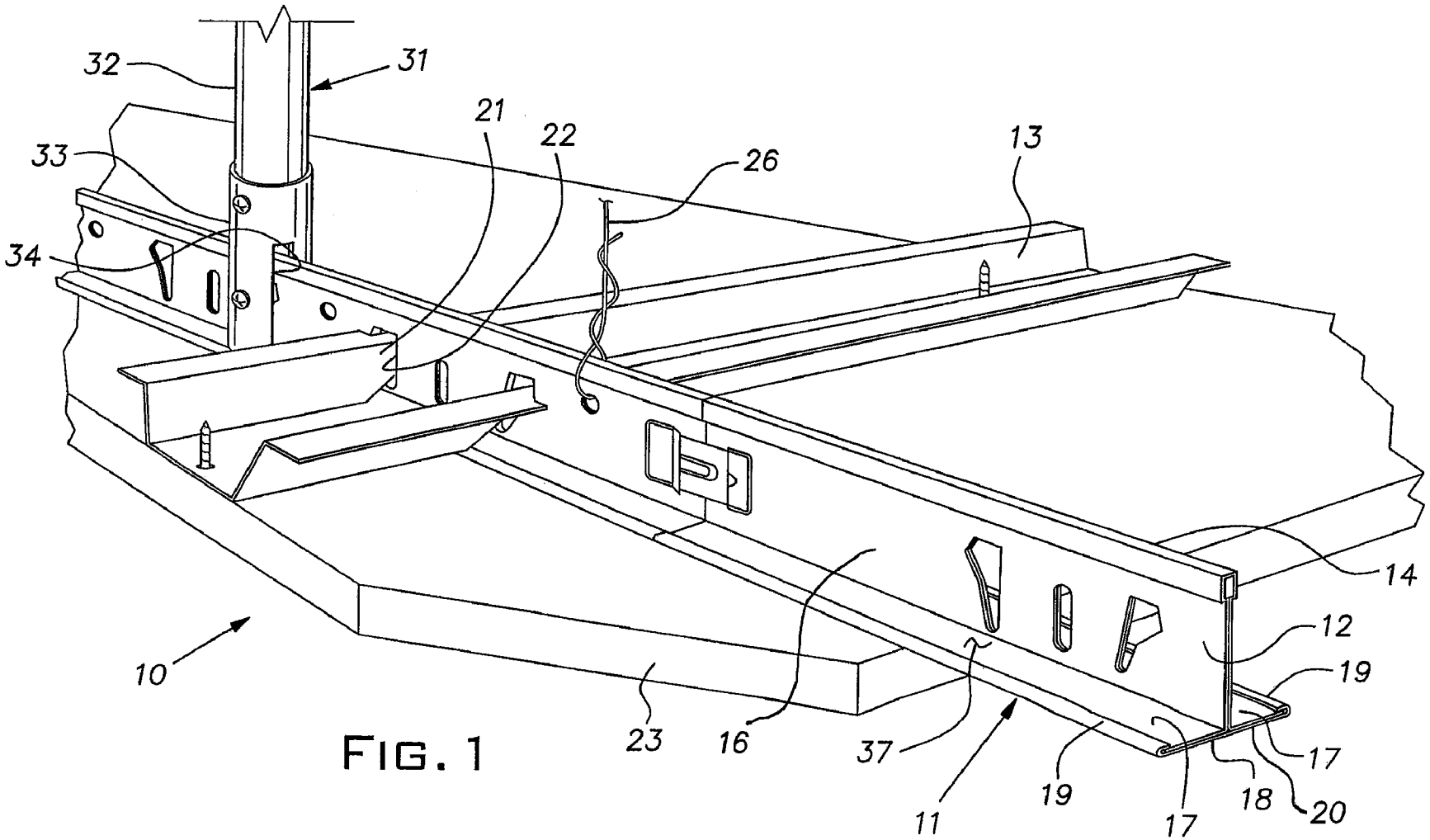
FIG. 1 is a fragmentary perspective view of a suspended soffit system taken from a vantage point above the soffit plane showing one form of compression post assembly according to the invention.

FIG. 1 represents a first embodiment of a suspended soffit, canopy or like static structure 10 that is exposed to up-lift wind loading. The structure or system 10 includes a rectangular grid 11, of generally known, conventional construction. The grid 11 includes main runners 12 in the form of inverted tees and cross runners 13 shown as flanged U-shaped channels. The main runners 12 are preferably formed of sheet metal, as is conventional, and have a hollow reinforcing bulb 14 at an upper edge, a double web 16 extending from the bulb and flange portions 17 extending from opposite sides of the web. The flange portions 17 can be covered at a lower face of the main runner 12 by a sheet metal strip that forms a cap 18 with its longitudinal edges 19 folded over the longitudinal digital edges of the flange portions 17. Together the flange portions 17 and cap 18 form a flange proper 20. Typically, the overall height of the bulb 14 is 1½", its width is ¼' and the flange 20 is 15⁄16" or 1½" wide. Preferably, the cross runners 13 are formed of sheet metal and have ends that overlie the main runner flange portions 17 and cap edges 19. The cross runners 13 include tabs 21 that extend through slots in the web 16 of the main runner 12.

Suitable rigid water-resistant or waterproof panel material is secured to the lower faces of the main and cross runners 12 and 13. This panel material 23 can be SHEET ROCK® brand exterior ceiling board, FIBER ROCK® brand sheeting, AQUA-TOUGH™ and DUROCK® brand cement board, such being trademarks of USG Corporation. The panels 23 are attached in a conventional manner with self-drilling and tapping screws, for example. The main runners 12 are suspended from overlying structure, i.e. superstructure, by hanger wires 26. The hanger wires 26, made of 12 gauge steel suitably coated, are typically used in suspension ceilings, as well as soffits, and offer an inexpensive, quick and reliable way of hanging a suspended ceiling-like structure. The wires 26, while affording adequate tensile force to support the weight of a ceiling or soffit, afford essentially no compression strength.

Figure 2:
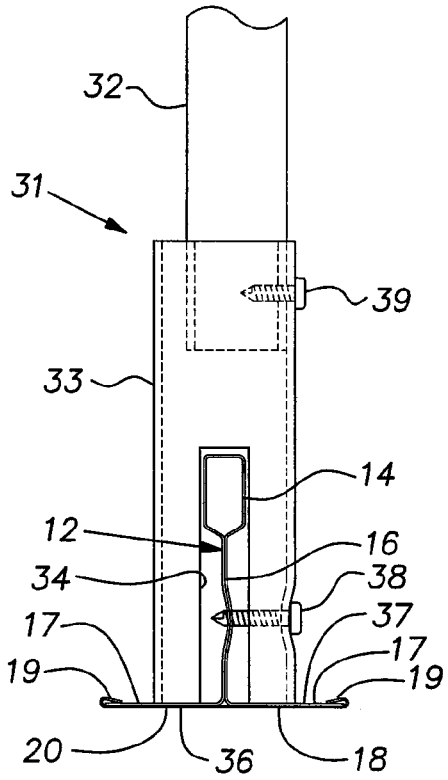
FIG. 2 is an elevational view of a lower area of the compression post assembly of FIG. 1 and its relation to a main runner of a grid part of the soffit system.
Figure 5:
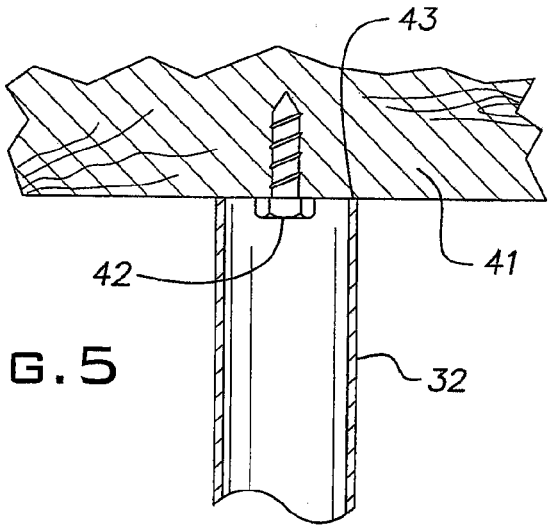
FIG. 5 is a cross-sectional view of an upper end of a compression post assembly showing one example of a connection with a wooden superstructure.
Figure 6:
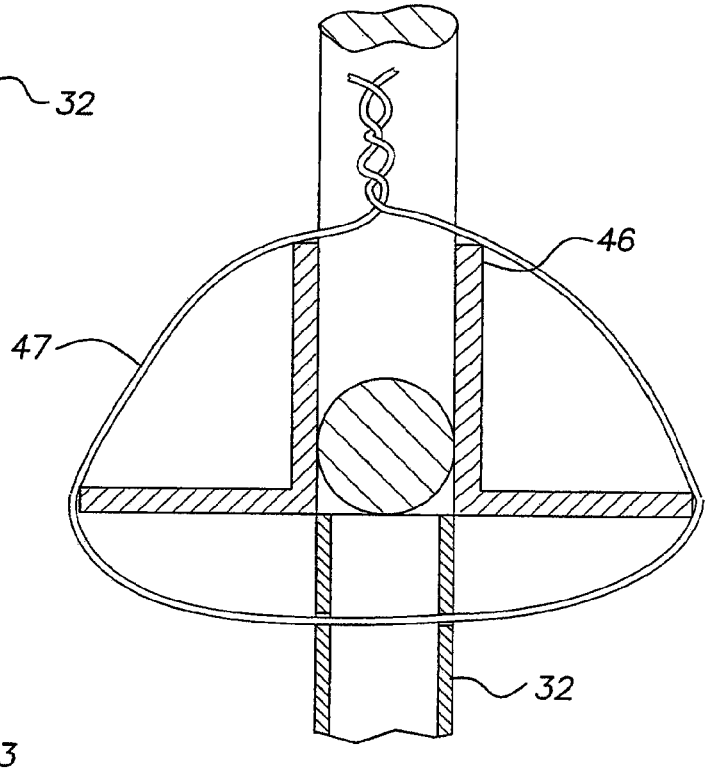
FIG. 6 is a cross-sectional view of an upper end of a compression post assembly showing a connection with a steel bar joist superstructure.
Figure 7:
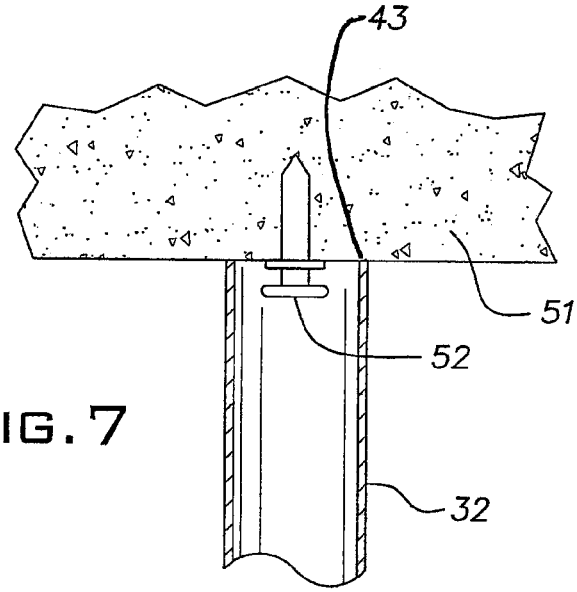
FIG. 7 is a cross-sectional view of an upper end of a compression post assembly showing a connection with concrete superstructure.

The soffit installation 10 includes compression post assemblies 31 spaced along the lengths of the main runners 12 to hold the soffit down against wind up-lift forces that can exceed the weight of the soffit itself. The compression post assemblies 31 transfer the up-lift wind load on the soffit to the superstructure from which the soffit is hung. A compression post assembly 31 includes a main strut shaft or post 32 and a saddle fitting 33. The main shaft 32 is preferably made of round tube stock and, in particular, can be made from thin wall electrical conduit or electrical metal tubing (E.M.T.). In FIGS. 1 and 2, the main shaft 32 is made of nominal ½" E.M.T. The main post 32, ordinarily, can be cut to length at the location where the soffit 10 is constructed. The length of the main post is slightly less than the distance between the top of the bulb 14 of the particular main runner 12 being supported from the superstructure directly above the main tee. Ordinarily, the compression post assembly is installed after the grid 11 is in place so that appropriate measurements can be made to determine the suitable length of the main post 32. FIGS. 5-7, discussed below, show how a compression post assembly 31 may be located on a superstructure. The saddle fitting 33 can be made from tubing stock such as ¾" E.M.T. cut to a length somewhat greater than the height of a main runner; for instance, with a length 1½ to two times the height of a main runner. The tube stock of the saddle fitting 33 is formed with diametrally opposite slots 34 extending from a lower end 36 lengthwise or axially for a distance at least equal to the height of an upper surface 37 of the main runner bulb 14 to the flange 20 of the main runner represented by the folded-over edges 19 of the cap 18. The length of the slots 34 preferably enables the lower end 36 of the fitting 33 to rest against and bear upon the main runner flange 20, formed by the cap edges 19, without interfering or being obstructed by the reinforcing bulb 14. In assembly, the saddle fitting 33 is telescoped with the main post 32 by slipping it over the main post. Depending in part on the manner by which the main shaft is located on the superstructure, the saddle fitting 33 can be slipped up over the main post 32, aligned over a bulb 14 of a main runner 12 and dropped down against the main runner flange 20. Alternatively, the saddle fitting 33 can be placed on the main runner flange 20 and the main shaft or post 32 can thereafter be telescoped into the fitting 33.

With the fitting 33 resting on and abutted against the upper flange surface 37, the fitting can be fixed to the main runner 12 with a self-drilling, self-tapping screw fastener 38. The main post 32 received in telescoping relation with the saddle fitting 33 abuts or can be raised to abut the overlying superstructure and in this position is fixed to the saddle fitting by a self-drilling, self-tapping screw fastener 39 which can be identical to the screw 38 holding the fitting to the main runner 12. With the fitting 33 screwed or otherwise fixed to the tee 12 and the post or shaft 32 screwed or otherwise fixed to the fitting, these elements form a rigid structure.

The compression post assembly 31 is easily used with any common superstructure. FIG. 5 illustrates use of the compression post assembly 31 with a wood truss or joist 41 forming the superstructure. A suitable screw, e.g. a wood screw or heavy drywall screw 42 is partially driven into the joist 41 directly above a main runner 12 where the saddle fitting 33 is located or will eventually be located. FIG. 6 illustrates an example of an installation of the compression post assembly 31 where the superstructure includes a steel bar joist 46. The upper end of the main shaft 32 is secured to the bar joist 46 by cross-drilling the main post and affixing it to the bar joist with a wire 47. It will be seen that the upper post end 43 is abutted against the lower face of the bar joist 46. FIG. 7 illustrates installation of the compression post assembly 31 with a superstructure formed of a concrete beam or slab 51. A powder driven anchor 52, known in the art, is driven into the concrete 51 and the upper end 43 of the main post 32 is abutted against the lower face of the concrete 51.

Figure 3:
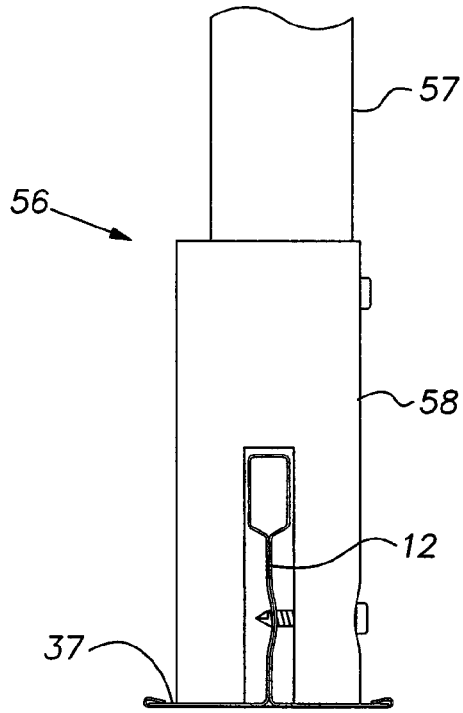
FIG. 3 is an elevational view of a lower part of a second form of a compression post assembly in accordance with the invention.
Figure 4:
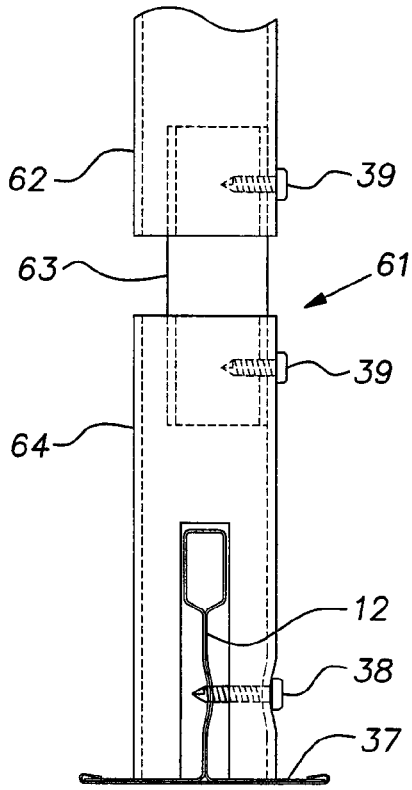
FIG. 4 is an elevational view of a lower part of a third exemplary form of a compression post assembly.

FIG. 3 illustrates the lower area of a compression post assembly 56 that has a larger load bearing capacity and/or a longer strut or post length limitation than that of the compression post assembly 31 illustrated in FIGS. 1 and 2. The compression post assembly includes a strut or post 57 which can be made from ¾" E.M.T. A saddle fitting 58 can be made of a short length of 1" E.M.T. that is slotted in the same manner as the earlier described fitting 33. FIG. 4 illustrates still another form of a compression post assembly 61. The assembly 61 comprises a main post or shaft 62, made for example of ¾" E.M.T., a splice segment 63 made from ½" E.M.T. and a saddle segment or fitting 64 made of ¾" E.M.T. As before, the saddle fitting or element 64 is slotted to straddle the bulb 14 and web 16 to enable the lower end of the saddle to abut the upper flange surface 37. The splice segment 63 is telescoped within the shaft or post 62 and saddle 64. As in the earlier embodiments, the saddle is fixed by a screw 38 to the main runner 12 and the splice segment 63 is fixed to the saddle 64 and post 62 by separate screws 39.

Figure 8:
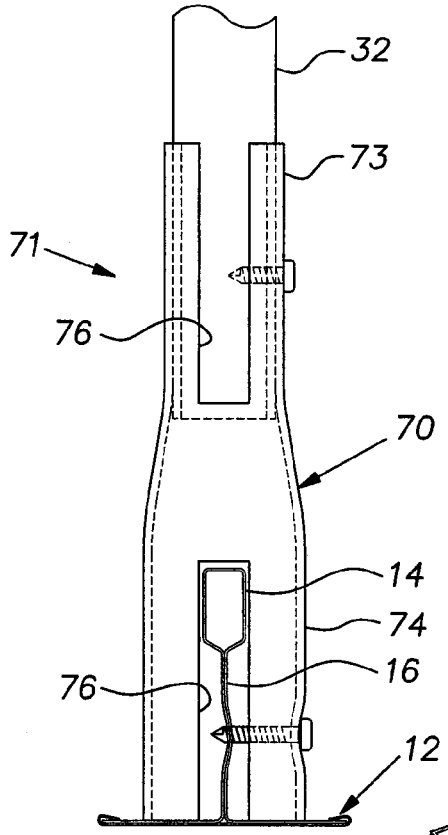
FIG. 8 is an elevational view of a lower part of a compression post assembly showing a specially formed saddle fitting with a small diameter main strut.
Figure 9:
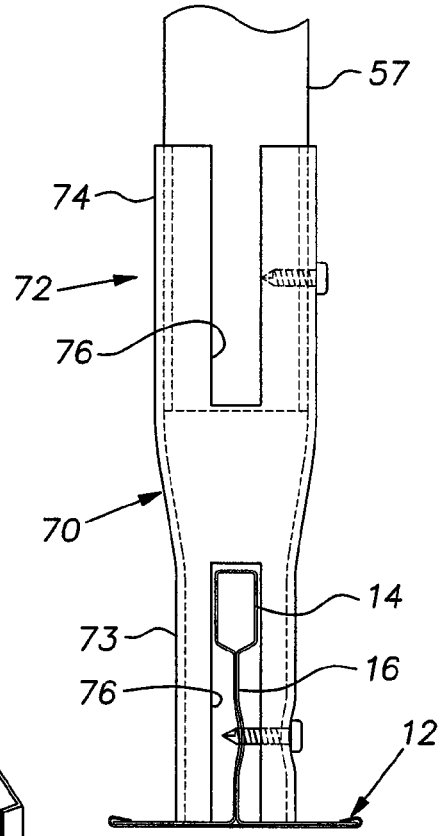
FIG. 9 is an elevational view similar to FIG. 8 showing the special saddle fitting with a larger diameter main strut.

FIGS. 8 and 9 illustrate a saddle fitting 70 in compression post assemblies 71 and 72. The saddle fitting 70 is a tubular member having different diameters at respective ends 73, 74. Each end 73, 74 is provided with slots 76 adapted to receive the bulb and web 14, 16 of a main runner 12.

Figure 10:
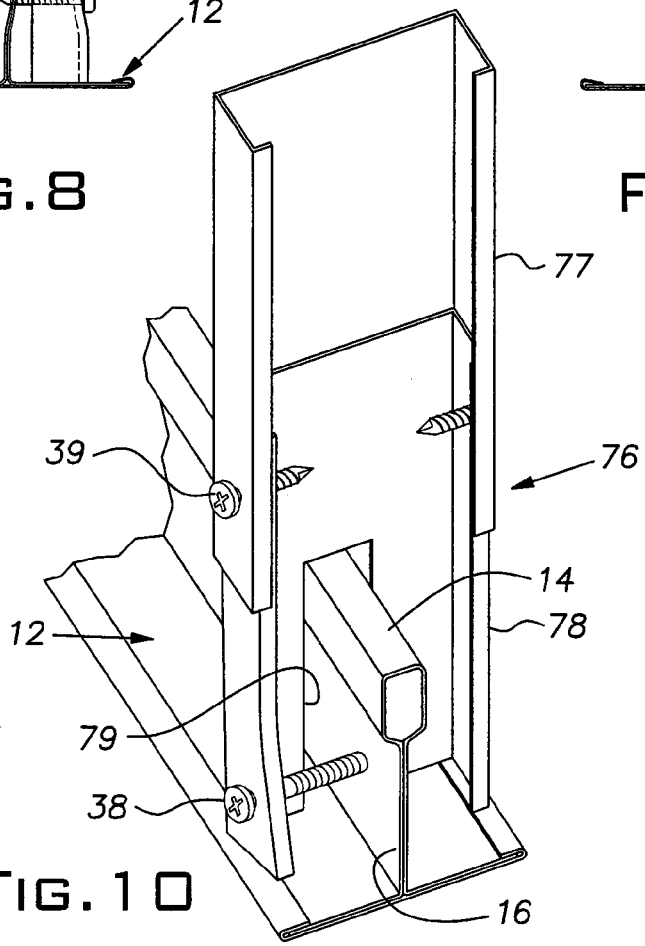
FIG. 10 is a fragmentary perspective view of a second type of compression post assembly.

FIG. 10 illustrates a modified form of a compression post assembly 76. The assembly comprises a rectangular channel that forms the main shaft 77 or strut and a saddle fitting 78. The compression post assembly 76 is analogous to the previous circular tube arrangements shown in the previously described figures. The saddle fitting 78 has a U or C-shaped configuration in a horizontal cross-section and includes a slot 79 sized to enable it to be assembled over the bulb 14 and web 16 of a main runner 12. The fitting 78 is proportional to slide in telescoped relation to the main shaft 77. The fitting 78 is fixed with its lower end abutting the upper side of the tee flanges by a screw 38 to the main tee 12 and the main shaft 77 by a screw 39. As described in connection with the previous embodiments, the main shaft 77 has its upper end abutted against a downwardly facing surface of an overlying superstructure or is otherwise suitably fixed or anchored to the same in a vertical position.

The compression post assembly of the invention is characterized by a sliding, preferably telescoping fit between a main post and a saddle element. The saddle element is arranged to surround the bulb and web of an inverted T-shaped main runner and to stabilize the main runner by contacting the lower flange of the main runner on both sides of the web. With the saddle fitting fixed both to the main runner and to the main shaft, the main runner is prevented from prematurely buckling by twisting about its longitudinal axis. The telescoping relation between the saddle fitting and main shaft or strut is very dimensionally tolerant of variations between the ideal length of a main post in relation to the actual distance between a main runner and its overlying superstructure.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. A suspended soffit installation comprising a suspended rectangular grid and a compression post assembly, the rectangular grid being formed by runners including an inverted tee runner having an upper bulb and a cross runner intersecting the tee runner, the grid supporting underlying panels forming a soffit surface, the compression post assembly including a main strut and a saddle coupling, the main strut having upper and lower ends, the saddle coupling connecting the lower end of the strut to the grid tee runner by separate self-tapping screws, one received in each of the main strut and grid tee runner, the saddle coupling having a pair of spaced depending legs, the legs being spread apart by a distance sufficient to straddle the bulb of the grid tee runner and having a length sufficient such that it engages upper surfaces of a lower flange of the grid tee runner and thereby stabilizes the grid tee runner against pivotal motion about a horizontal axis.

2. A suspended soffit installation as set forth in claim 1, wherein said main strut is a hollow tube.

3. A suspended soffit installation as set forth in claim 2, wherein said hollow tube is round.

4. A suspended soffit installation as set forth in claim 1, wherein both said main strut and saddle coupling are hollow tubes having their respective axis substantially coincident.

5. A suspended soffit installation as set forth in claim 1, wherein said saddle coupling is telescoped with said main strut.

6. A method of constructing a soffit for a building exposed to wind, comprising suspending a rectangular grid of inverted tees from a superstructure of a building that overlies an area of the soffit, providing a plurality of compression post assemblies that are each of a length that extends generally vertically from the superstructure to the plane of the grid, the post assemblies being provided with upper and lower parts, the lower part being arranged to straddle the central web of an inverted tee and engage the lower flange on opposite sides of the central web at points spaced a distance from the central web, fixing the upper end of the upper part to the superstructure and fixing the lower part to the central web of the inverted tee.

7. A method as set forth in claim 6, wherein the grid is suspended from the superstructure with suspension wires.

8. A method as set forth in claim 6, wherein the lower part of a post assembly is telescoped on the upper part.

9. A method as set forth in claim 6, wherein the upper part of a post assembly is provided as a hollow steel tube.

10. A method as set forth in claim 6, wherein the lower part is fixed to the grid tee with a self-drilling, self-tapping screw and to the upper part with a separate self-drilling, self-tapping screw.

* * * * *